US006834717B2

(12) United States Patent
Bland

(10) Patent No.: US 6,834,717 B2
(45) Date of Patent: Dec. 28, 2004

(54) TUBING ROTATOR

(75) Inventor: Linden H. Bland, Edmonton (CA)

(73) Assignee: R&M Energy Systems, Inc., Houston, TX (US)

( * ) Notice: Subject to any disclaimer, the term of this patent is extended or adjusted under 35 U.S.C. 154(b) by 93 days.

(21) Appl. No.: 10/264,673

(22) Filed: Oct. 4, 2002

(65) Prior Publication Data

US 2004/0065434 A1 Apr. 8, 2004

(51) Int. Cl.[7] ..... E21B 19/00; E21B 19/02
(52) U.S. Cl. ..... 166/78.1; 166/92.1; 166/75.14
(58) Field of Search ..... 166/377, 380, 166/381, 382, 75.11, 77.51, 86.1, 85.3–85.5, 78.1, 921, 75.14

(56) References Cited

U.S. PATENT DOCUMENTS 2,693,238 A * 11/1954 Baker ..... 166/78.1
4,690,221 A * 9/1987 Ritter, Jr. ..... 166/382
5,139,090 A * 8/1992 Land ..... 166/369
5,383,519 A * 1/1995 Wright et al. ..... 166/78.1
5,429,188 A * 7/1995 Cameron et al. ..... 166/78.1
5,732,777 A * 3/1998 Grimshaw et al. ..... 166/382
5,964,286 A * 10/1999 Cuppen ..... 166/78.1
6,026,808 A 2/2000 Armer et al.
6,026,898 A * 2/2000 Bland et al. ..... 166/78.1
6,102,116 A * 8/2000 Giovanni ..... 166/77.51
6,192,981 B1 * 2/2001 Boquet et al. ..... 166/75.13
6,199,630 B1 * 3/2001 Blundell et al. ..... 166/78.1
6,543,533 B2 * 4/2003 Meek et al. ..... 166/78.1
6,588,510 B2 * 7/2003 Card et al. ..... 166/382
6,640,892 B1 * 11/2003 Wright ..... 166/78.1
2002/0121367 A1 * 9/2002 Meek et al. ..... 166/78.1
2003/0024709 A1 * 2/2003 Cuppen ..... 166/382
2003/0192688 A1 * 10/2003 Thomson et al. ..... 166/78.1

* cited by examiner

*Primary Examiner*—David Bagnell
*Assistant Examiner*—Jennifer H Gay
(74) *Attorney, Agent, or Firm*—Loren G. Helmreich; Browning Bushman, P.C.

(57) ABSTRACT

Tubing rotator 10 includes a main body or rotator spool 20, a selected bottom connector 50, and a selected top connector 70. The bottom connector 50 may be adapted for a screw cap type wellhead or a flanged wellhead. The top connector may comprise a pin connection mandrel 72 with either a threaded or flanged upper end, or a flow-T and/or BOP housing that bolts to the top of the spool. The tubing rotator may be adapted for hanging the tubing directly from the tubing rotator or may be used with a double box bushing 110 hung within the tubing rotator. The tubing rotator may also use a swivel hanger 120 included in the tubing head.

34 Claims, 12 Drawing Sheets

TUBING ROTATOR

FIELD OF THE INVENTION

The present invention relates to oilfield equipment referred to as rotators for rotating tubing string in a well. More particularly, this invention relates to a tubing rotator with selectable top and bottom connectors for use with a standard spool, so that the tubing rotator may be used in various well applications.

BACKGROUND OF THE INVENTION

Tubing rotators are used to suspend and rotate a tubing string within the well bore of an oil well. By slowly rotating the tubing string, typical wear occurring within the internal surface of the tubing string by the reciprocating or rotating rods, interior of the string, is distributed over the entire internal surface of the tubing string. As a result, the tubing rotator will prolong the life of the tubing string. Further, rotation of the tubing string relative to the rod string will inhibit buildup of wax or other materials within the tubing string.

Tubing rotators normally are mounted on the flange of a tubing head of a wellhead. In some tubing rotators the tubing string is suspended directly from a rotating output shaft of the tubing rotator. In a second style tubing rotator, the tubing string is suspended from the inner mandrel of a rotatable hanger, which is suspended in the tubing head. In this second style rotator, a hexagonal shaped or other spline shaped output shaft of the tubing rotator engages the inner mandrel to provide rotation of the tubing string. Packing or other seals within the tubing head seal off the well annulus. Tubing heads thus may have a flanged bottom for connecting to the wellhead, and a flanged top for connection to the tubing rotator. Tubing heads alternatively may be threaded at their top end for connection with either a screwed cap or a tubing rotator.

In wellheads that have flanged tubing head tops, the tubing heads are available in many different sizes and pressure ratings. Each size and each pressure rating has different dimensions, bolt size and bolt configuration. Unlike a rotator for threaded engagement with the tubing head, a flanged rotator may be easily positioned rotatably in one of, e.g., 12 equally spaced rotational positions to desirably orient the rotator drive shaft, e.g., worm shaft, with respect to the wellhead and other equipment about the wellhead which functions as a mechanical power source for rotating the drive shaft of the rotator, which then directly or with intermediate components rotates the tubing string.

While a tubing rotation body or spool is attached in a selected manner to the top of the tubing head, the connector at the top of the tubing rotator spool will vary widely in thread type and size, or alternatively in the flange type and pressure rating. In some cases, the spool body or spool of the tubing rotator is integral with either the top connector or the tubing head connector (bottom connector) to the wellhead, and in other cases both the top connector and the tubing head connector are integral with the tubing rotator spool. As a result, a tubing rotator manufacturer must have a wide variety of tubing rotator spools and corresponding internal components in stock to satisfy various applications. U.S. Pat. No. 6,026,898 discloses a one-piece body with a combination flow-T, BOP, and tubing rotator.

Tubing rotators may be driven in a number of ways to function as the source of the rotator drive shaft to rotate the tubing string: (1) they may be driven manually with a ratchet handle; (2) by attaching the ratchet handle to the walking beam with a cable or chain, so that walking beam movement is the power source; (3) by a AC or DC electric motor through a gear reducer; or (4) by a right angle drive attached to the rotating polished rod of a progressing cavity pump, through a flexible drive shaft and gear reducer. In each of these cases, the drive rotates the tubing rotator drive, e.g., worm shaft, which then rotates the tubing string.

With existing tubing rotators, the spool or body of the tubing rotator may thus be different for each configuration, size or pressure rating of the wellhead. As a result, a different mounting bracket for the drive system or power source is required for each style of tubing rotator.

In reciprocating pump jack applications, the lower end of the tubing is often anchored to the casing in tension to prevent vertical movement of the bottom end of the tubing as the pump plunger moves up and down. If the tubing is permitted to move, the effective pump stroke is reduced, thereby reducing pumping efficiency. In order to set the tubing in tension, the top end of the tubing string is lowered below its final landing position when setting the anchor. After the anchor is set, the tubing may then be stretched upward, the lift sub removed, and the hanger attached and landed in the tubing head or the tubing rotator. While the lift sub is being removed and a hanger screwed on, the tubing may be supported in the rig slips. The tubing is over-stretched by the height of the slips plus the distance from the top end of the tubing joint to the bottom of the upset. On shallow wells, the tubing often cannot be stretched this much without yielding the tubing or shearing the shear pins in the anchor.

The disadvantages of the prior art are overcome by the present invention, and an improved tubing rotator is hereinafter disclosed which is easily adaptable for use in various applications.

SUMMARY OF THE INVENTION

The tubing rotator may be mounted directly onto either a screwed or a flange type tubing head (wellhead). A tubing rotator spool with a standard main body may be adapted to any wellhead configuration, size or pressure rating by attaching a selected top connector and a selected bottom connector for rigid attachment to the tubing rotator spool. The tubing rotator may also be installed on a well with an anchor without over-stressing the tubing or the anchor.

It is an object of the invention to provide a tubing rotator for attaching to a wellhead for rotating a tubing string, with the rotator including a rotator spool for housing a drive shaft interconnecting a power source and a tubing string for rotating the tubing string, a top connector removably attached at a lower end to an upper end of the rotator spool, and a bottom connector removably attached at an upper end to the lower end of the rotator spool and its lower end to the wellhead. In a preferred embodiment, the rotator spool may include a first set of ports aligned for connecting a selected top connector with the spool housing, and a second set of ports each radially outward from the first set of ports and aligned for connecting another selected top connector with the spool housing.

In another embodiment, it is an object of the invention to provide a tubing rotator wherein the rotator spool may be integral with or removable from a top connector, with the rotator including a bottom connector attached at an upper end to the lower end of the rotator spool and attached at a lower end to the wellhead. The bottom connector includes a retainer sub secured to the spool housing, and a retainer plate removably secured to the retainer sub. The retainer sub may be removably connected to or may be integral with the spool housing.

It is a feature of the present invention that the bottom connector may include threads which tighten in response to torque imparted to rotate the tubing string to prevent unthreading of the connection.

A further feature of the invention is that a locking mechanism may be provided for preventing unthreading of the bottom connector from the rotator spool due to torque imparted to rotate the tubing string.

Yet another feature of the invention is that a double box bushing may be provided within the rotator spool for setting a tension anchor.

A further feature of the invention is that the top connector may include a flow T and/or a BOP.

Another feature of the invention is that a swivel tubing hanger may be used with a locking fitting to prevent the tubing rotator from being improperly installed.

Yet another feature of the invention is that the bottom connector may be attached to the wellhead such that the rotator spool and drive shaft may be oriented in a selected direction relative to the wellhead.

These and further objects, features, and advantages of the present invention will become apparent from the following detailed description, wherein reference is made to figures in the accompanying drawings.

DESCRIPTION OF THE PREFERRED EMBODIMENTS

Figure 2:
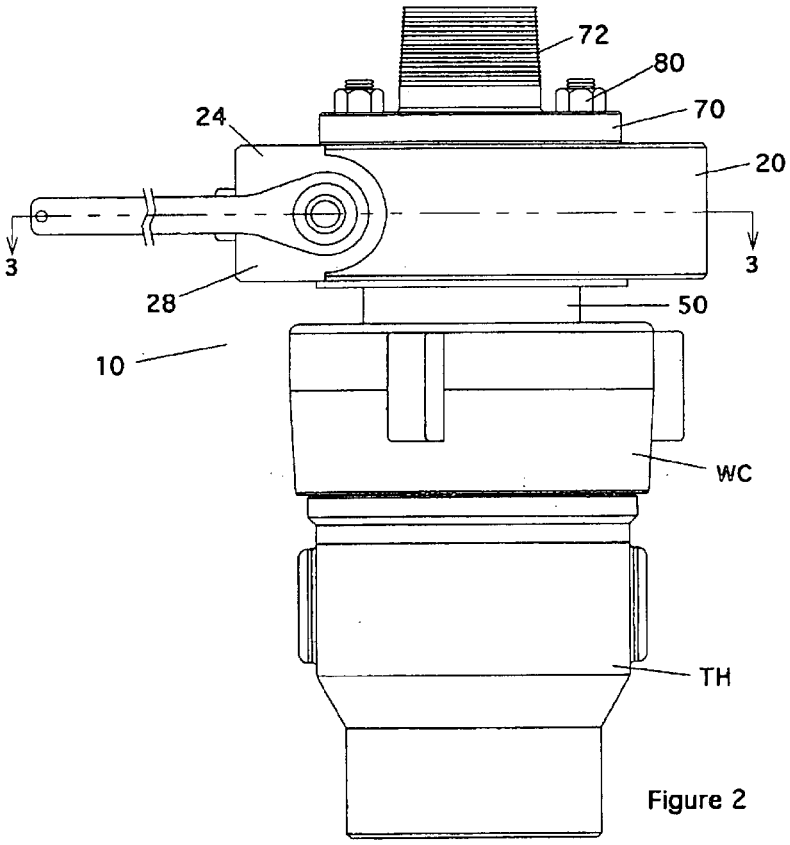
FIG. 2 is a side view of a tubing rotator configured for screw cap type wellheads.

A tubing rotator 10 according to the present invention has a modular construction with three primary components: a main body or spool 20, a bottom connector 50, and a top connector 70. These components are mounted on the top of tubing head TH as shown in FIG. 2, and are held in place by a wellhead cap WC.

Figure 1:
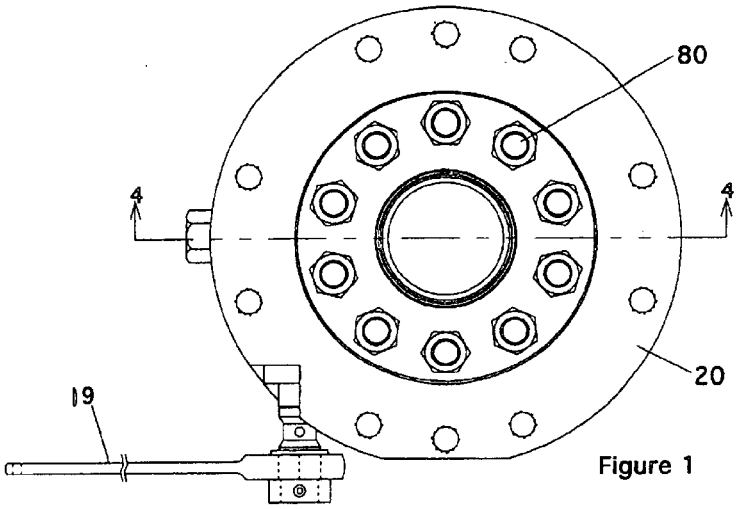
FIG. 1 is a top view of one embodiment of a tubing rotator.
Figure 3:
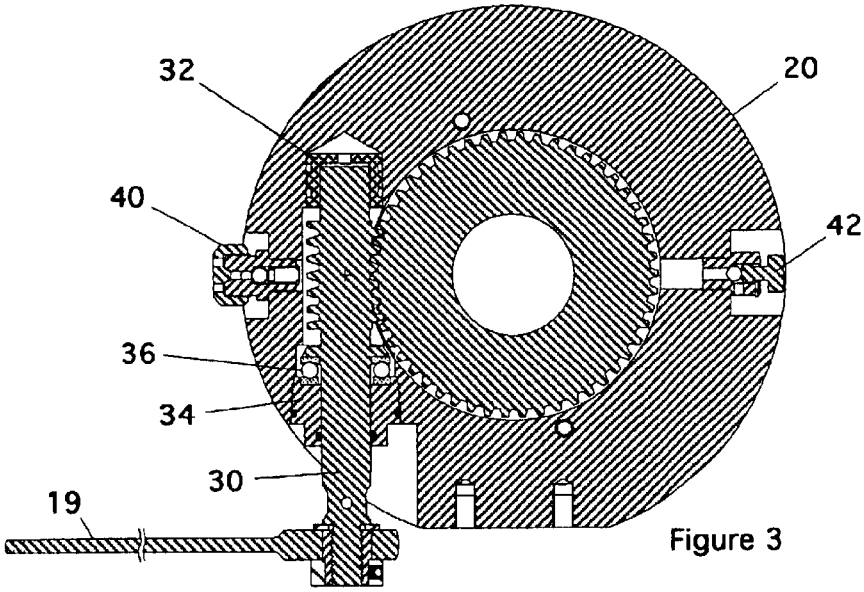
FIG. 3 top sectional view of the main body or spool for the tubing rotator.
Figure 4:
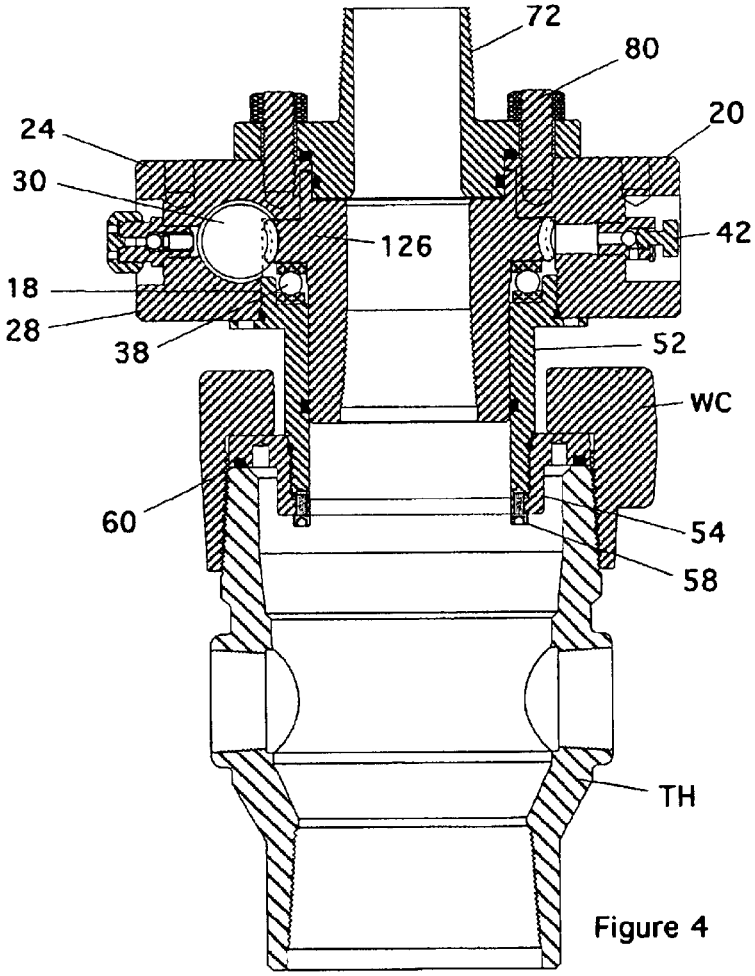
FIG. 4 is a sectional side view of the tubing rotator configured for a screw cap type wellhead, with the tubing hung directly from the tubing rotator drive shaft.
Figure 5:
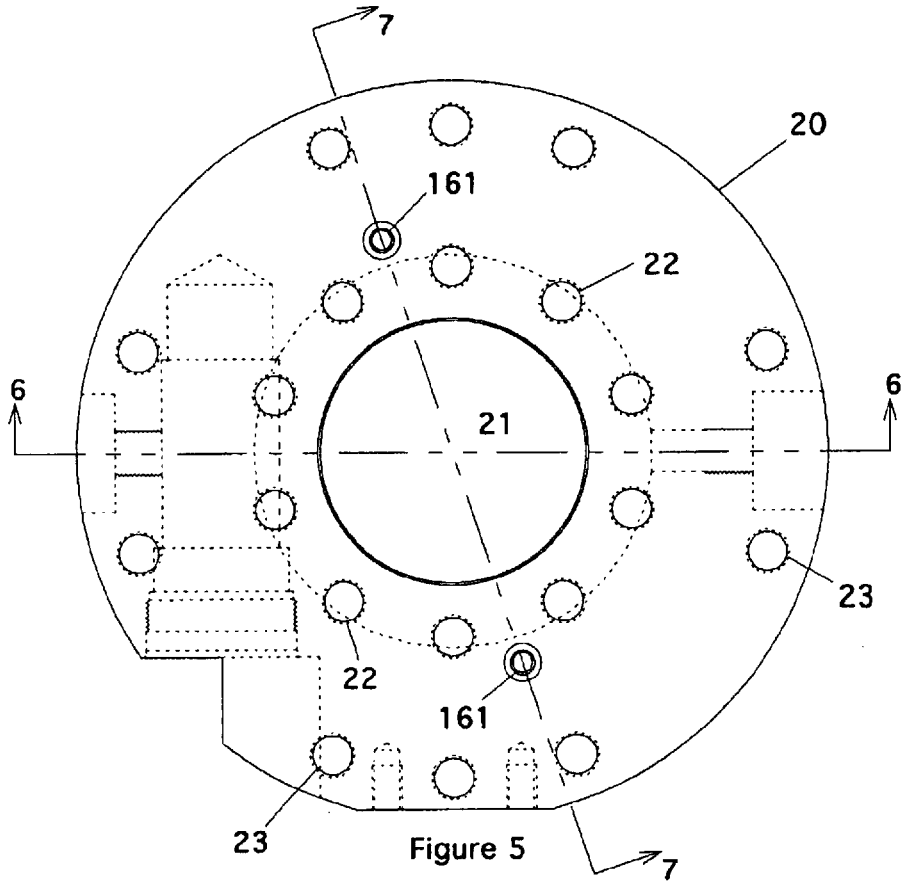
FIG. 5 is a top view of the tubing rotator body or spool used in various tubing rotator configurations.
Figure 6:
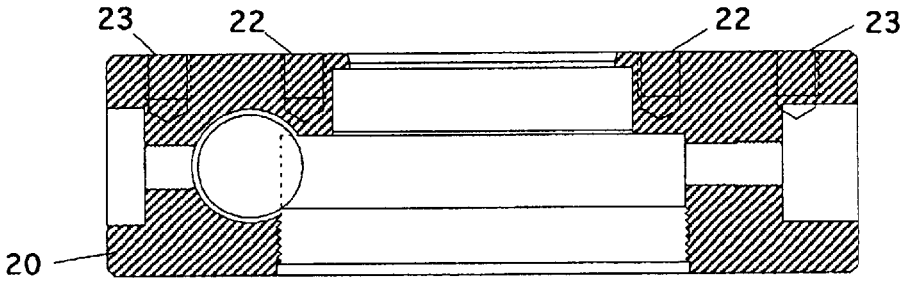
FIG. 6 is a sectional side view of the spool along lines 6—6.
Figure 7:
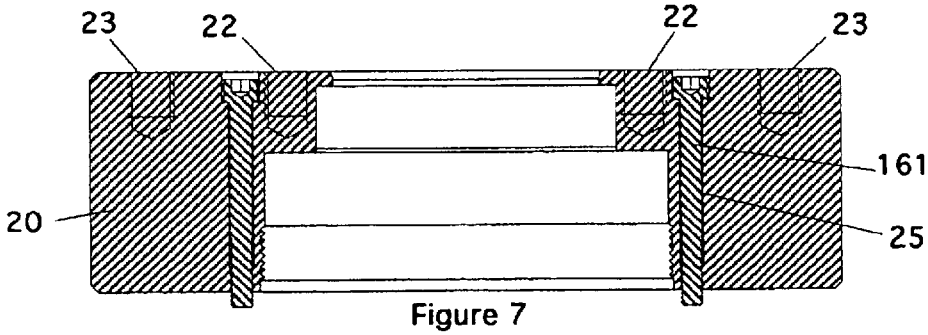
FIG. 7 is a sectional size view of the spool along lines 7—7 showing the locking screw holes.
Figure 8:
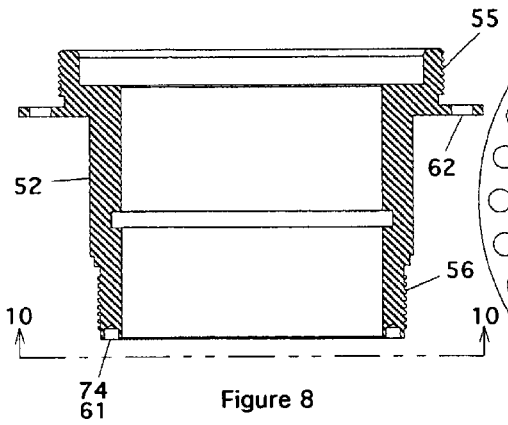
FIG. 8 is a sectional side view of the retainer sub for a screw cap type rotator.
Figure 10:
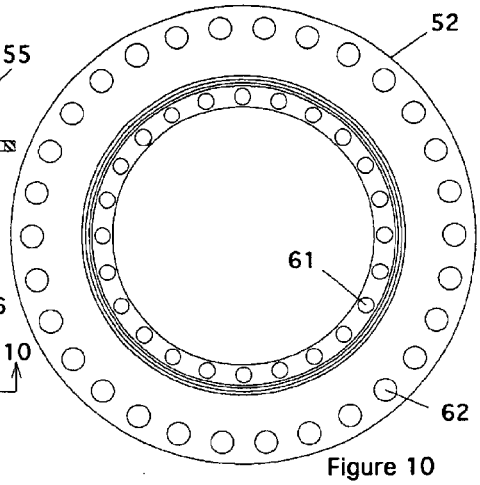
FIG. 10 is a bottom view of a retainer sub showing the two sets of engagement holes for locking screws.
Figure 9:
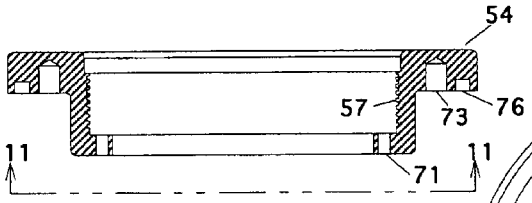
FIG. 9 is a sectional side view of the retainer plate for a screw cap type rotator.
Figure 11:
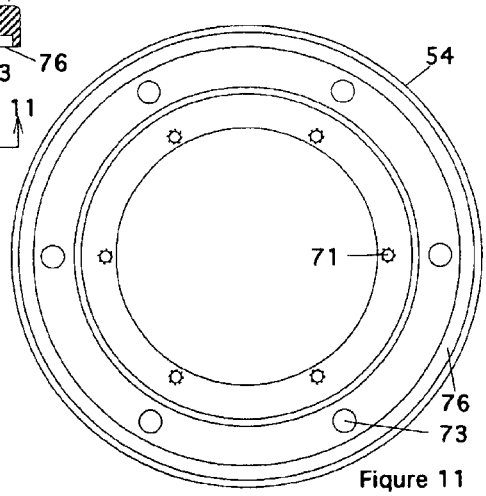
FIG. 11 is a bottom view of a retainer plate showing six threaded holes for locking screws and six holes for a spanner wrench.

The main body or spool 20 may have the same configuration for all wellhead options or alternatives that exist in oilfield operations. Referring to FIGS. 4 and 5, the spool 20 has threaded bolt holes 22 and 23 at a different radial spacing from the centerline 21 of the rotator at its upper end 24 for attaching a selected one of a variety of top connectors. The spool 20 has thread 18 (see FIG. 4) at its lower end 28 for attaching a selected one of a variety of bottom connectors. The spool 20 conventionally houses a drive shaft, e.g., a worm shaft 30, as shown in FIGS. 3 and 4, and for the worm shaft configuration, a worm bushing 32, a bushing nut 34, a worm ball thrust bearing 36, a tubing thrust bearing 38, a lube fitting 40 and a vent fitting 42, which now may be the same for that size tubing rotator spool for various applications. FIGS. 5–7 show further features of a conventional rotator housing, and are discussed further below. A drive handle 19, which may be interconnected with a pump jack walking beam, is shown in FIGS. 1 and 3 for rotating the worm shaft and thus the tubing string during each upward stroke of the pump jack.

The bottom connector 50 for a screw cap type wellhead includes a retainer sub or adaptor flange 52, and a retainer plate 54, as shown in FIGS. 4 and 8–10. Different sizes of retainer subs and retainer plates are required for different sizes of screw cap type wellheads. Adapter flange 52 includes threads 55 for threaded engagement with the threads 18 on spool 20, and a plurality of circumferentially spaced holes 62 on a large diameter and another plurality of circumferentially spaced holes 61 spaced on a smaller diameter. Adapter flange 52 also includes threads 56 at its lower end for interconnection with mating threads 57 on the retainer plate 54. The retainer plate 54 preferably includes a first plurality of ports 73 on a large diameter, and a second plurality of ports 71 on a smaller diameter. The purpose of ports 71 is to rotatably secure the plate 54 to the flange 52 by bolts 58, as shown in FIG. 4, which pass through plate 54 and into a respective hole 74 in the bottom of flange 52. The ports 73 are positioned for receiving a conventional spanner wrench to conveniently thread the plate 54 to the flange 52.

The groove 76 is sized to receive the o-ring 60 shown in FIG. 4. Cap screw 161 as shown in FIGS. 5 and 7 pass through a port 25 in the spool 20 and into a respective port 61 in the flange 52, thereby rotatably locking the flange 52 to the spool 20. The terms "adapter flange" and "retainer plate" as used herein are broadly intended to refer to any removable flange member which serves the purposes disclosed herein, and to a retainer plate which may have various configurations, but serves it function to retain the adapter flange in position on the tubing head th, with the tubing rotator spool 20 then being supported on the adapter flange.

Figure 18:
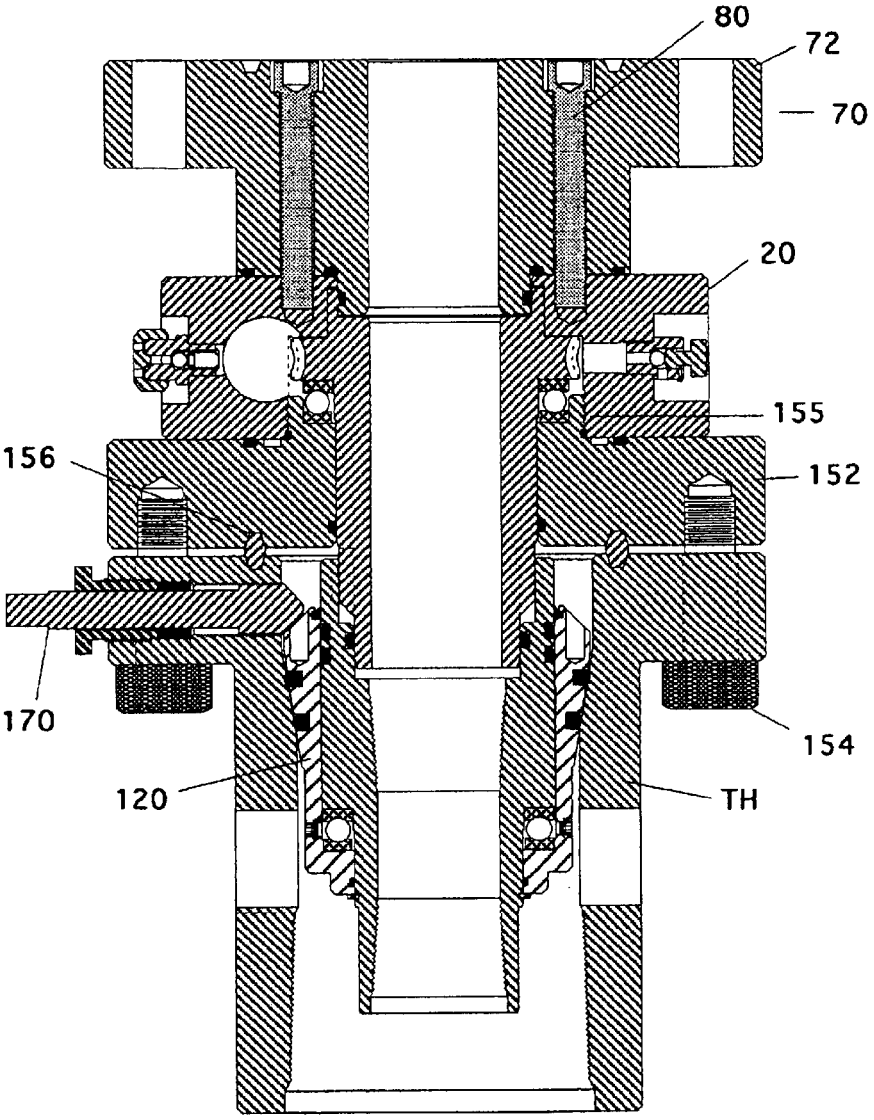
FIG. 18 is a sectional side view of a tubing rotator configured for a flanged type wellhead with a flanged top connector, with tubing hung from a swivel hanger resting in a tubing head.

For flanged wellheads, the bottom connector 50 includes an adapter flange 152, as shown in FIG. 18. Different adapter flanges are required for different size and pressure rated wellheads. The adapter flange 152 screws into the bottom of the spool 20 with threads 155 mating with threads 18 on the spool 20, and is locked from screwing back out by one or more thread locking mechanisms, such as cap screws 161 as discussed above, which each pass through holes 25 in the rotator body 20 (see FIG. 7) then terminate in a respective circumferentially arranged hole in flange 152.

In assembling the rotator, the retainer sub or adapter flange 52, 152 may be screwed fully onto the spool 20 and then backed up a fraction of a turn until the holes align with the respective cap screws 161. The cap screws 161 may then be screwed in fully to lock the parts together. By selecting the number of circumferentially spaced holes (e.g., from 2 to 30 holes spaced uniformly about the retainer sub), the maximum back up of the retainer sub may be controlled, e.g., a maximum of 12 degrees to get the holes to align for a 30 hole arrangement. This is important because backing out the retainer sub changes the alignment of the worm drive gear. Backing up 12 degrees only lowers the retainer sub 0.005" so the limited rotational movement is within worm alignment tolerances. In the case of the screw cap type wellhead, the retainer plate may be attached in the same manner to the retainer sub. Six cap screws in the retainer plate may then be aligned with 6 of 24 holes in the bottom of the retainer sub.

Figure 19:
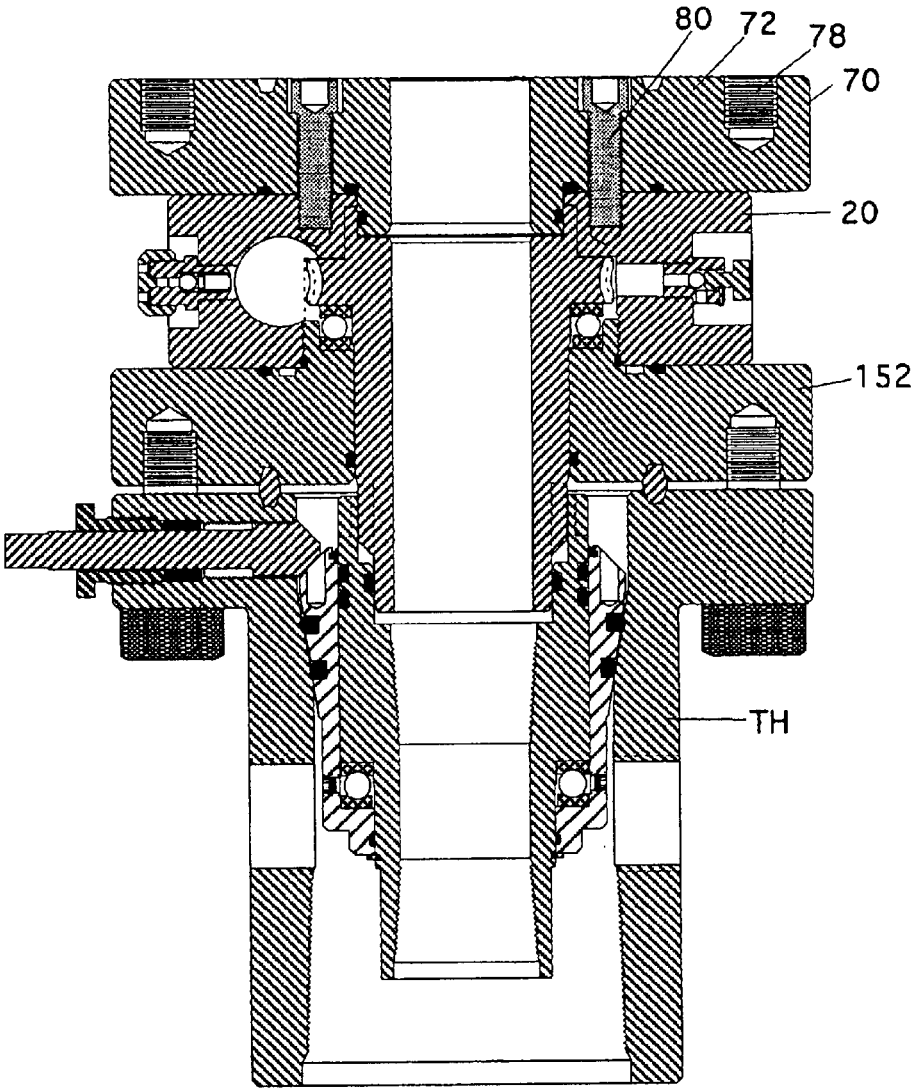
FIG. 19 is a sectional side view of a tubing rotator configured for a flanged type wellhead with a studded top connector, with tubing hung from a swivel hanger resting in a tubing head.
Figure 20:
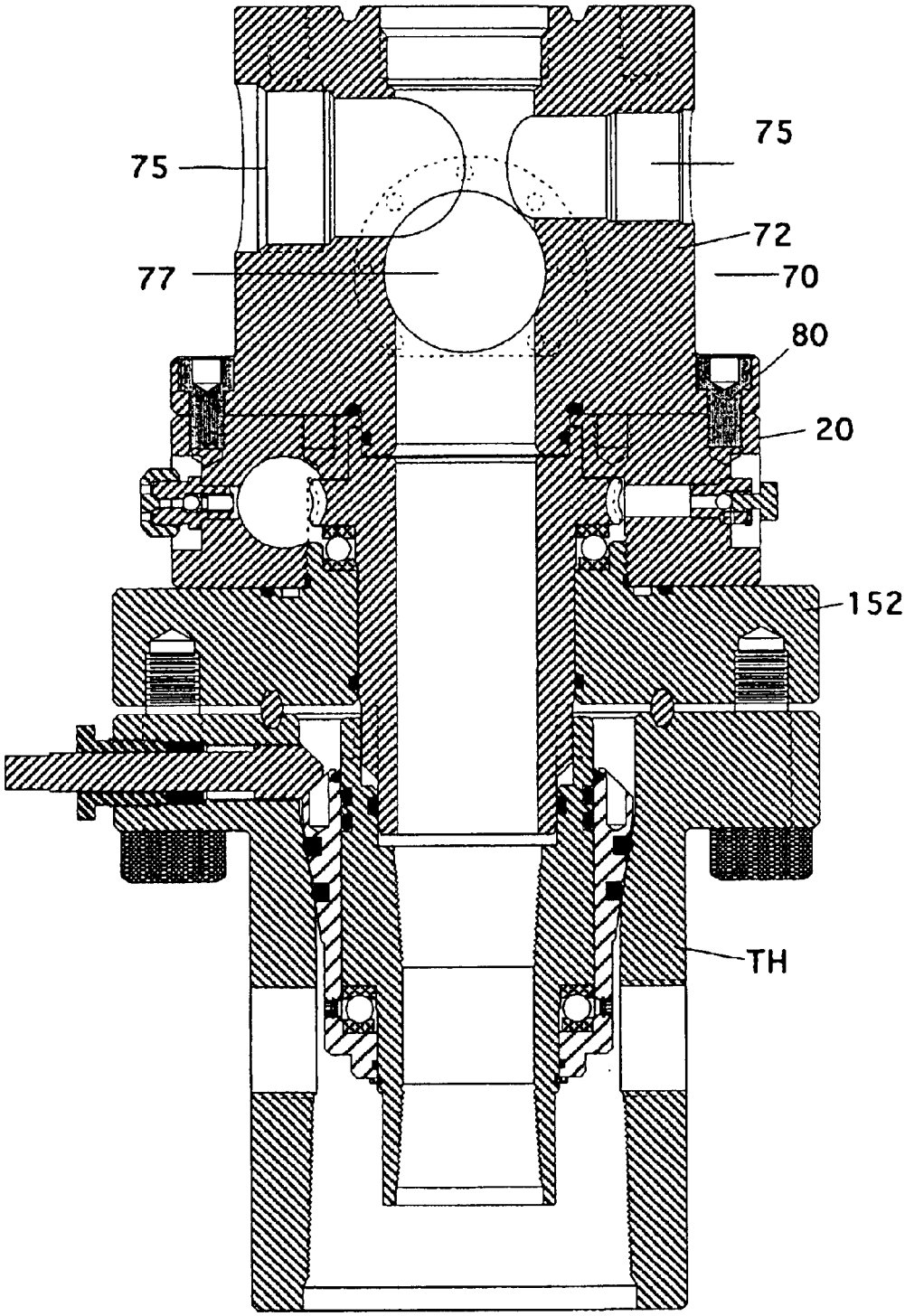
FIG. 20 is a sectional side view of a tubing rotator configured for a flanged type wellhead, with tubing hung from a swivel hanger resting in the tubing head and with a studded up top connector including a flow-T/BOP.

FIG. 18 shows a tubing rotator used with a flange-type tubing head TH. Bolts 154 secure the tubing head TH to the adapter flange 152, and a fluid tight connection provided by seal 156. Locking mechanism 170 is provided for securing the swivel hanger 120 in place on the tubing head. In FIG. 18, a top connector 70 with an upper flange end is secured to the spool 20 by bolts 80, which terminate in ports 22 shown in FIGS. 5 and 6. FIG. 19 illustrates the top component 72 similarly bolted to spool 20, with the body 72 containing downwardly extended threaded ports 73, so that another oilfield component may be bolted directly to the top connector 72. FIG. 20 is a sectional view of another tubing rotator configured for a flange-type wellhead. In this application, the top component housing 72 includes a housing which serves the purpose of both a flow T and a BOP. Housing 72 thus includes radially opposing lateral flow ports 75 and radially opposing BOP rams 77 for closing flow through the housing 72. Housing 72 is similarly bolted to the rotator spool 20 by bolts 80, although different bolt holes in spool 20 are used.

The top connector 70 connects the top of the tubing rotator spool. For many tubing rotator configurations, the top connector is made up to a pin connection mandrel 72. The pin connection mandrel in turn may either be threaded or flanged at its upper end (see FIGS. 13, 18 and 19) for connection with conventional oilfield equipment. In either case, the connector 70 may be secured to the top of the tubing rotator spool with bolts or cap screws 80, as shown in FIGS. 2, 4, 12, 13 and 18–20. There are two sets of threaded bolt holes 22, 23 in the top of the spool (see FIG. 5). The bolt holes 22 on the smaller bolt circle may be used to attach the pin connector mandrel 72 to the spool 20, or to attach one of the top connectors shown in FIG. 18 or 19 to the spool. The top connector may alternatively include a flow-T, a BOP, combination flow-T and BOP, or another oilfield device that bolts to the top of the spool as shown in FIG. 20. For this attachment, the bolt holes 23 on the larger bolt circle may be used. The selected flow-T housing or BOP housing may thus be easily bolted to the rotator spool.

A tubing rotator configured for screw cap type wellhead (e.g., FIG. 4) may be installed in the following manner. The six cap screws 58 may be removed from the retainer plate 54 and the retainer plate 54 screwed off of the retainer sub 52. The screw cap WC from the wellhead may then be slid on over the retainer sub 52, and the retainer plate 54 then screwed back on and locked in place with the six cap screws 58. The tubing rotator may then be screwed onto the tubing string (in the FIG. 4 case, the tubing is hung directly from the worm gear 30). The tubing rotator may then be lowered onto the tubing head TH and orientated into the desired position for the drive system, or for other considerations. The cap WC may then be screwed down and tightened. An O-ring 60 (see FIG. 4) in the bottom face of the retainer plate 54 is pressed up against the top face of the tubing head TH to facilitate a seal, and also provides a limited braking mechanism so that the tubing rotator spool will not rotate due to the back torque required to rotate the tubing. An O-ring groove in the retainer plate may be 0.015" narrower than the O-ring so that the O-ring will stay in its groove when the tubing rotator is lifted off the wellhead.

Figure 12:
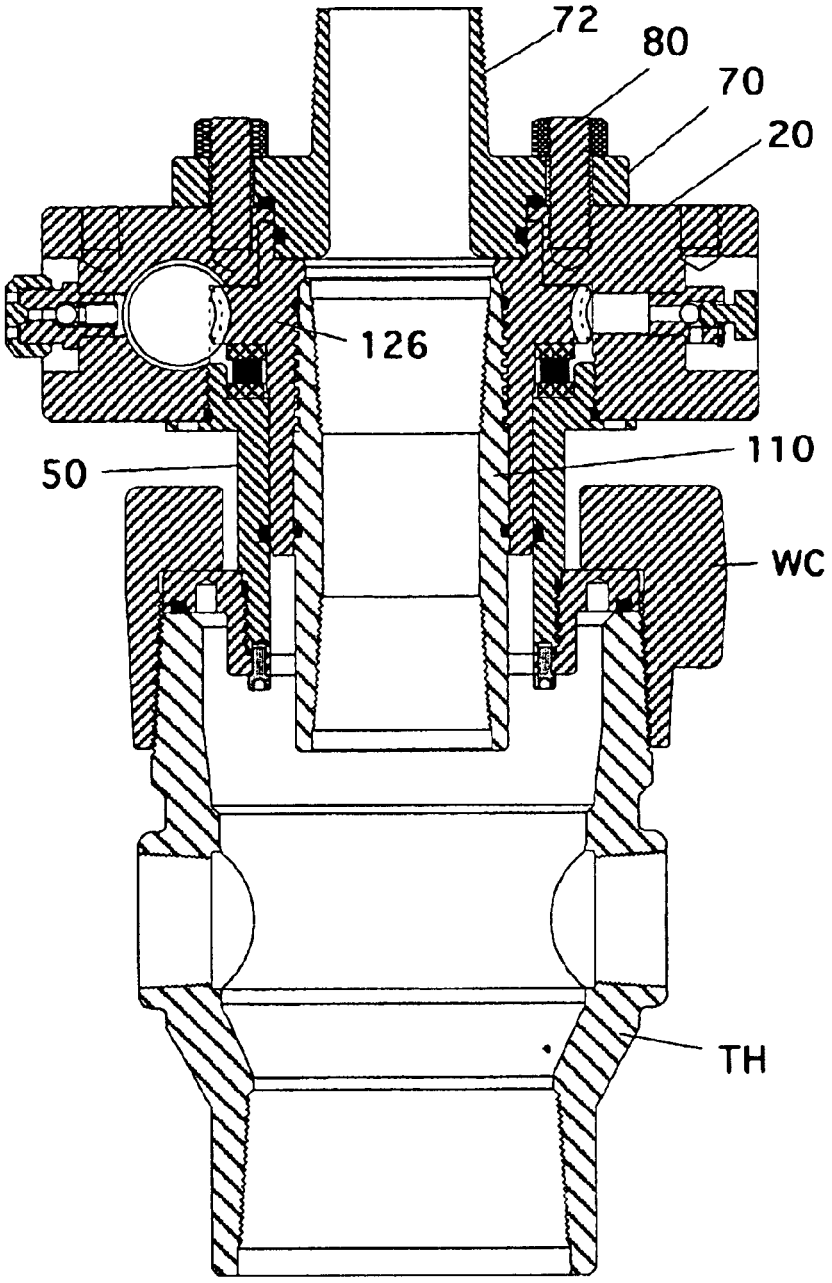
FIG. 12 is a sectional view of the tubing rotator configured for a screw cap type wellhead with the tubing hung from a double box brushing.

A tubing rotator configured for screw cap type wellhead and incorporating a double box bushing is shown in FIG. 12. Double box bushings are commonly used when the tension anchor is to be installed in the well. An anchor and tubing rotator with double box bushing 110 may be installed in the following manner. The screw cap WC is installed onto the tubing rotator as outlined in the previous paragraph. The procedure for installing the anchor and tubing rotator is described below.

To set the anchor:

1. Make up the tubing string, including the right hand set anchor, tubing swivel and double box bushing 110, to locate the downhole pump at the desired depth will be in the final landing position.
2. Run in the tubing string and land on the rig slips.
3. Pick up the tubing rotator and screw it, to the right, onto the top of the double box bushing. Hand tight only.
4. Remove the nuts from the top of the tubing rotator and remove the pin connection mandrel from the top of the tubing rotator.
5. Lower a pick-up sub through the top of the tubing rotator and screw this sub into the top of the double box bushing 110. Tighten to at least minimum make up torque of the tubing.
6. Pick up the tubing string and tubing rotator with the elevators, remove the slips and lower the tubing string until the tubing rotator touches the top of the wellhead. Screw the tubing rotator back off of the double box bushing but leave it around the lift sub, sitting loose on the wellhead.
7. Lower the tubing string, through the tubing rotator, to the anchor setting position and set the anchor by rotating the tubing to the right. Follow conventional anchor setting procedures.

8. When the anchor is set, rotate hard to the right, e.g., 600 ft lbs, to shear out the tubing swivel shear pins.
9. Stretch the tubing back up till the double box bushing picks up the tubing rotator. Screw the tubing rotator to the right to thread it fully onto the double box bushing. Tighten it by hand to about 100 ft lbs.
10. Lower the tubing string until the wellhead cap WC engages the screw type tubing head. Orient the tubing rotator so the worm shaft is in the desired position and screw the wellhead cap onto the wellhead. Lower the tubing string gradually while screwing the cap down until the full string weight can be set down on the tubing rotator. Tighten the cap.
11. Rotate the lift sub to the left out of the double box bushing, and reinstall the pin connection mandrel onto the top of the tubing rotator.
12. Install the other components of the wellhead.

To unset the anchor:

1. Remove the components of the wellhead from above the tubing rotator.
2. Remove the pin connection mandrel from the top of the tubing rotator.
3. Screw a lift sub into the top of the double box bushing. Tighten to optimum make up torque of the tubing. Pick up string weight plus string tension and rotate hard right until the double box bushing begins to thread out of the tubing rotator.
4. Break the wellhead cap loose and screw it off. It will be necessary to raise the tubing string gradually while screwing the cap off.
5. Rotate the tubing rotator to the left, by hand until it is off of the double box bushing.
6. Lower the tubing until string weight remains and unset the anchor by rotating to the left.
7. Pick the string up and land it in the rig slips.
8. Screw out the lift sub, remove the tubing rotator and screw off the double box bushing.

Either of the configurations shown in FIG. 4 or 12 may incorporate an adapter flange as the bottom connector rather than the retainer sub and retainer plate.

Figure 13:
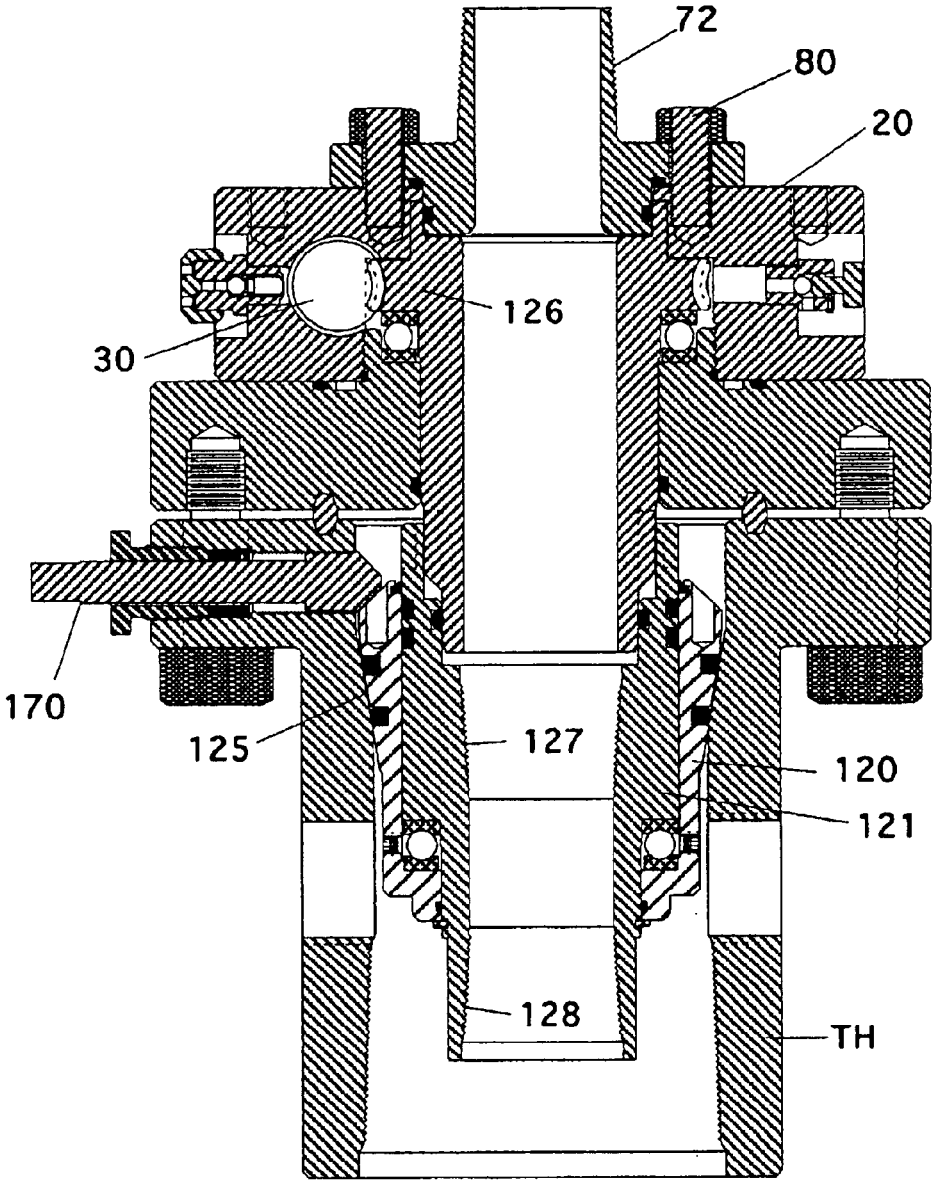
FIG. 13 is a sectional side view of the tubing rotator configured for flanged type wellhead with a tubing hung from a swivel hanger resting in the tubing head.

In order to maintain well control, it is often preferred to hang the tubing from a swivel hanger 120 as shown in FIG. 13, which is hung from a shoulder 125 in the tubing head TH. The tubing rotator may be driven to rotate a worm 30 that engages a sleeve 126 having a hexagonal shaped exterior lower end for positioning within a similarly configured bore in the upper end of the inner mandrel 121 of the swivel hanger 120.

Figure 16:
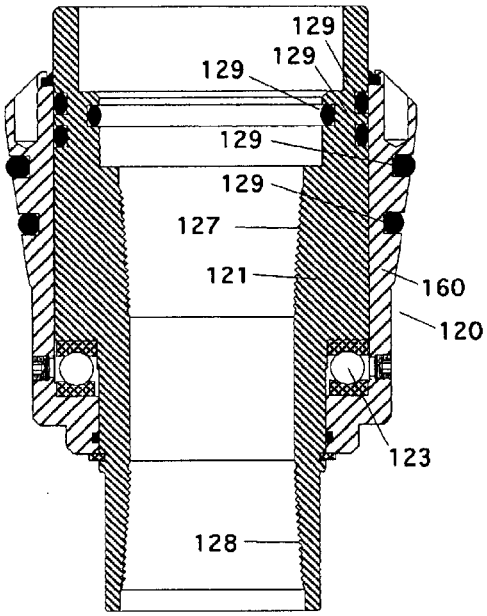
FIG. 16 is a sectional side view of a swivel hanger free to swivel.
Figure 17:
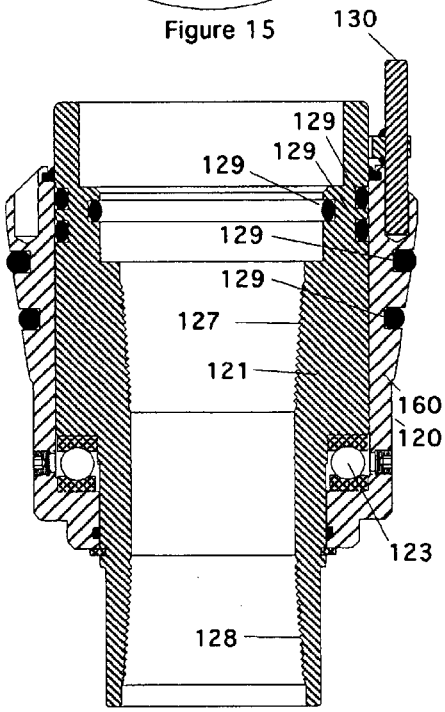
FIG. 17 is a sectional side view of a swivel hanger with the locking fitting installed.

FIGS. 16 and 17 illustrate the inner mandrel 121 and the swivel hanger 120 in the position where the hanger is free to swivel, and where the hanger 120 is rotationally locked to the inner mandrel 121. A bearing 123 is provided for facilitating rotation of the sleeve 121 with respect to the hanger outer shell 160 when the locking mechanism 130 is removed. A plurality of O-ring seals 129 are illustrated for providing sealing engagement with the sleeve 126 and the inner mandrel 121, between the swivel hanger outer shell 160 and the inner mandrel 121, and between the hanger outer shell 160 and the tubing head. Mandrel 121 preferably includes threads 127 which facilitate lifting the hanger 120 out of the tubing head TH, and threads 128 for interconnection with a tubing string (not shown). This configuration has the following features.

1. The lockdown screws remain effective while removing the wellhead and installing the rig BOP.
2. The swivel tubing hanger may be sized to be run or pulled through the rig BOP.
3. The swivel tubing hanger has a full bore, i.e., it has a bore diameter equal or larger than the bore of the tubing hung from it.
4. This configuration provides protection from tubing back spin when removing the tubing rotator.

Figure 14:
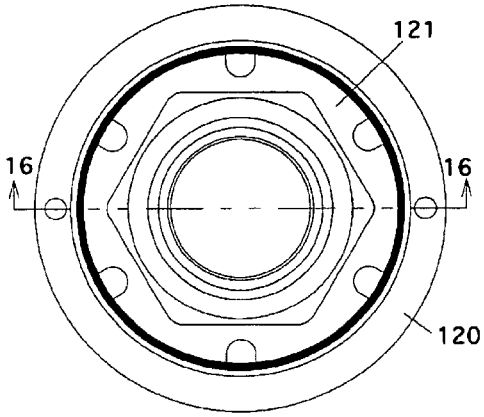
FIG. 14 is a top view of a swivel hanger free to swivel.
Figure 15:
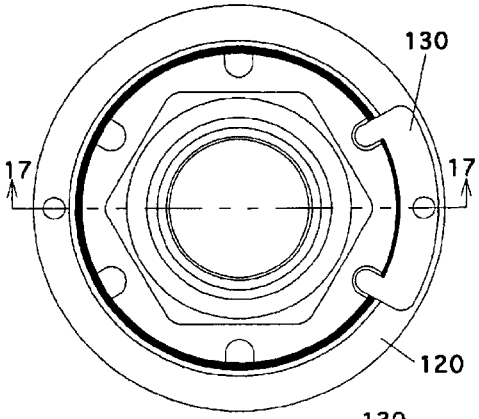
FIG. 15 is a top view of a swivel hanger with the locking fitting installed.

When the swivel tubing hanger 120 is lowered through the rig BOP and landed in the tubing head, the tubing lift sub is then backed out of the swivel tubing hanger. If the swivel tubing hanger is free to swivel, the lift sub cannot be backed out. For this reason, the swivel tubing hanger 120 has a locking mechanism 130. FIGS. 14 and 16 show the swivel tubing hanger 120 free to swivel. FIGS. 15 and 17 show the swivel tubing hanger in the locked position. the locking fitting 130 shown on FIGS. 15 and 17 is designed so that it may be in place while the swivel tubing hanger is lowered through the BOP and landed in the tubing head. After the lock down screws are engaged and the BOP is removed the locking fitting 130 is removed from the swivel tubing hanger so that it is free to swivel. The locking fitting when in place thus protrudes above the top of the tubing head so that the tubing rotator cannot be inadvertently installed with the swivel tubing hanger in the locked position.

Figure 21:
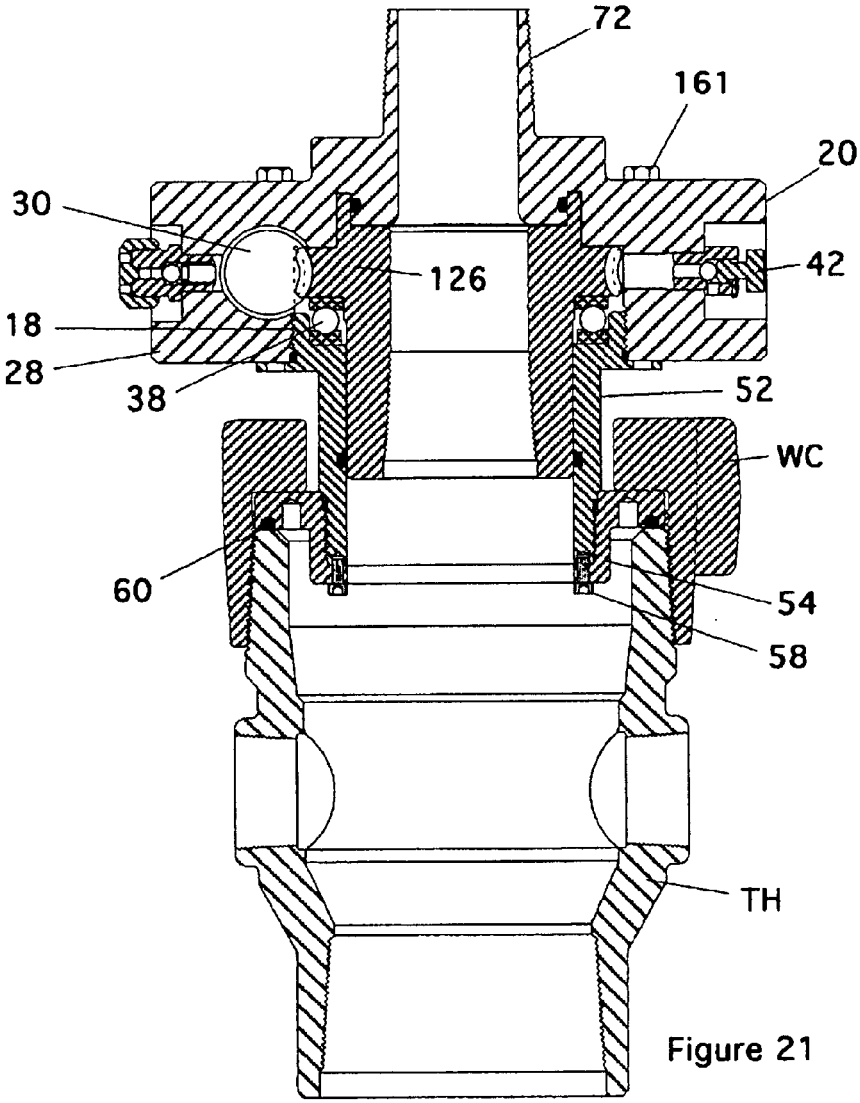
FIG. 21 illustrates a top connector integral with a spool, and a bottom connector threadably attached to a wellhead.

FIG. 21 depicts a tubing rotator secured in position above a tubing hanger TH by the screw cap WC. In the FIG. 21 embodiment, the top connector is shown as an integral housing with the spool housing 20, such that the threads 72 are formed directly on the spool housing. The tubing rotator is otherwise similar to the FIG. 12 embodiment, with a bottom connector including a retainer sub 52 removably secured to the rotator spool and a retainer plate 54 removably secured to the retainer sub and to the wellhead.

Figure 22:
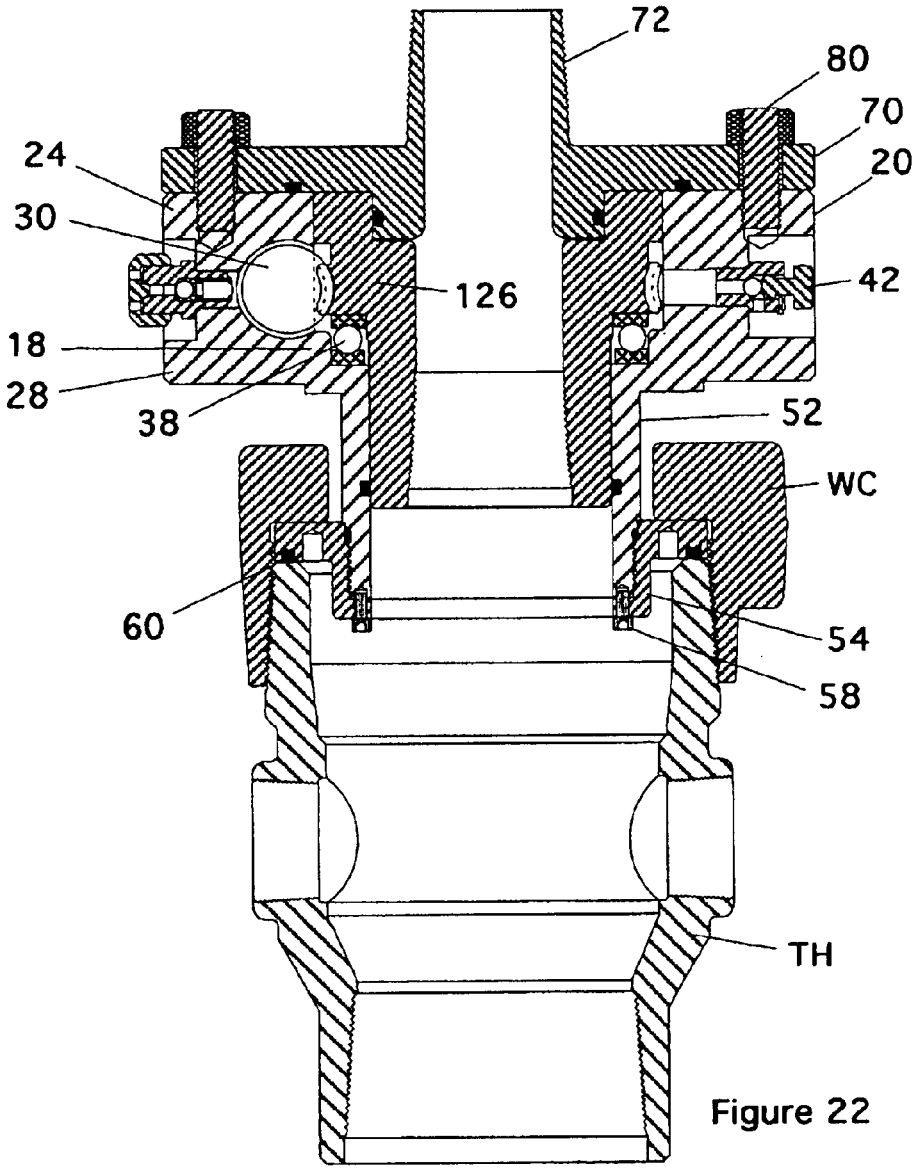
FIG. 22 illustrates a retainer sub integral with the spool and a retainer plate secured to the retainer sub.

In the FIG. 22 embodiment, the top connector is shown structurally separate from the spool housing, although for this embodiment the retainer sub 52 is integral with the spool housing 20, and the retainer plate 54 is removably secured to both the retainer sub 52 and the tubing head TH by the cap WC.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A tubing rotator for attaching to a wellhead for rotating a tubing string in a well, comprising:

a tubing rotator spool housing a drive shaft interconnecting a power source and the tubing string for rotating the tubing string;

a retainer sub removably secured to the spool housing;

a retainer plate removably secured to the retainer sub;

a top connector removably attached at its lower end to an upper end of the rotator spool; and a bottom connector removably attached at its upper end to a lower end of the rotator spool and at its lower end to the wellhead.

2. A tubing rotator as defined in claim 1, further comprising:

the retainer sub being threadably secured to the rotator spool and including a plurality of circumferentially spaced ports each for receiving a securing member for rotatably connecting the retainer sub to the rotator spool; and the retainer plate includes a plurality of circumferentially spaced ports for receiving a securing member to rotatably secure the retainer sub to the retainer plate.

3. A tubing rotator as defined in claim 1, further comprising:

a seal between the retainer plate and the wellhead.

4. A tubing rotator as defined in claim 1, wherein the bottom connector is threaded to the rotator spool, the tubing rotator further comprising:

a locking mechanism to prevent unthreading of the bottom connector from the rotator spool due to torque imparted to rotate the tubing string; and the bottom connector includes a plurality of circumferentially spaced holes for receiving the locking mechanism.

5. A tubing rotator as defined in claim 1, further comprising:

a double box bushing within the rotator spool for lowering beneath the rotator spool then securing to the rotator spool to set a tension anchor.

6. A tubing rotator as defined in claim 1, wherein the top connector includes a flow-T and BOP.

7. A tubing rotator as defined in claim 1, further comprising:

a swivel tubing hanger with a locking fitting to prevent the tubing hanger from swiveling when a lift sub is backed out of the swivel tubing hanger.

8. A tubing rotator as defined in claim 1, wherein the rotator spool comprises:

a first set of radially inward ports for connecting a selected top connector with the rotator spool; and a second set of radially outward ports for connecting another selected top connector with the rotator spool.

9. A tubing rotator as defined in claim 8, further comprising:

the top connector including a pin connection mandrel with one of a thread and a flange at its upper end for connection with oilfield equipment.

10. A tubing rotator as defined in claim 8, further comprising:

the top connector including at least one of a flow-T housing and a BOP housing.

11. A tubing rotator as defined in claim 1, wherein the bottom connector is attached to the wellhead such that the rotator spool and drive shaft may be oriented in a selected direction relative to the wellhead.

12. A tubing rotator for attaching to a wellhead for rotating a tubing string in a well, comprising:

a tubing rotator spool housing a drive shaft interconnecting a power source and the tubing string for rotating the tubing string, the rotator spool including a first set of radially inward circumferentially arranged ports aligned for connecting a selected top connector with the rotator spool, and a second set of radially outward circumferentially arranged ports each radially outward from the first set of ports and aligned for connecting another selected top connector with the rotator spool;

the top connector removably attached at its lower end to an upper end of the rotator spool; and a bottom connector attached at its upper end to a lower end of the rotator spool and at its lower end to the wellhead.

13. A tubing rotator as defined in claim 12, further comprising:

the top connector including a pin connection mandrel with one of a thread and a flange at its upper end for connection with oilfield equipment.

14. A tubing rotator as defined in claim 12, further comprising:

the top connector including at least one of a flow-T housing and a BOP housing.

15. A tubing rotator as defined in claim 12, wherein the bottom connector is attached to the wellhead such that the rotator spool and drive shaft may be oriented in a selected direction relative to the wellhead.

16. A tubing rotator as defined in claim 12, wherein the bottom connector is threaded to the rotator spool, the threaded connection including threads which tighten in response to torque imparted to rotate the tubing string to prevent unthreading of the threaded connection.

17. The tubing rotator as defined in claim 12, wherein the bottom connector comprises:

a retainer sub threadably secured to the rotator spool and including a plurality of circumferentially spaced ports each for receiving a securing member for rotatably connecting the retainer sub to the rotator spool; and a retainer plate removably secured to the retainer sub and including a plurality of circumferentially spaced ports for receiving a securing member to rotatably secure the retainer sub to the retainer plate.

18. A tubing rotator as defined in claim 12, further comprising:

a swivel tubing hanger with a locking fitting to prevent the tubing hanger from swiveling when a lift sub is backed out of the swivel tubing hanger.

19. A tubing rotator as defined in claim 12, further comprising:

a double box bushing within the rotator spool for lowering beneath the rotator spool then securing to the rotator spool to set a tension anchor.

20. A tubing rotator for attaching to a wellhead for rotating a tubing string in a well, comprising:

a tubing rotator spool housing a drive shaft interconnecting a power source and the tubing string for rotating the tubing string;

a top connector positioned above the rotator spool; and a bottom connector attached at its upper end to a lower end of the rotator spool and attached at its lower end to the wellhead, the bottom connector including a retainer sub secured to the spool housing, and a retainer plate removably secured to the retainer sub.

21. A tubing rotator as defined in claim 20, wherein the top connector is integral with the rotator spool.

22. A tubing rotator as defined in claim 20, wherein the top connector is removably connected to the rotator spool.

23. A tubing rotator as defined in claim 20, wherein the retainer sub is integral with the rotator spool.

24. A tubing rotator as defined in claim 20, wherein the retainer sub is movably secured to the rotator spool.

25. A tubing rotator as defined in claim 20, further comprising:

the retainer sub being threadably secured to the spool housing and including a plurality of circumferentially spaced ports each for receiving a securing member for rotatably connecting the retainer sub to the spool housing; and the retainer plate includes a plurality of circumferentially spaced ports for receiving a securing member to rotatably secure the retainer sub to the retainer plate.

26. A tubing rotator as defined in claim 20, further comprising:

a seal between the retainer plate and the wellhead.

27. A tubing rotator as defined in claim 20, wherein the bottom connector is threaded to the rotator spool, the tubing rotator further comprising:

a locking mechanism to prevent unthreading of the bottom component from the spool due to torque imparted to rotate the tubing string.

28. A tubing rotator as defined in claim 27, wherein the bottom connector includes a plurality of circumferentially spaced holes for receiving the locking mechanism.

29. A tubing rotator as defined in claim 20, wherein the bottom connector is attached to the wellhead such that the rotator spool and drive shaft may be oriented in a selected direction relative to the wellhead.

30. A tubing rotator for attaching to a wellhead for rotating a tubing string in a well, comprising:

a tubing rotator spool housing a drive shaft interconnecting a power source and the tubing string for rotating the tubing string;

a top connector removably attached at its lower end to an upper end of the rotator spool;

a bottom connector removably attached at its upper end to a lower end of the rotator spool and at its lower end to the wellhead;

a double box bushing within the rotator spool for lowering beneath the rotator spool then securing to the rotator spool to set a tension anchor;

a swivel tubing hanger with a locking fitting to prevent the tubing hanger from swiveling when a lift sub is backed out of the swivel tubing hanger.

31. A tubing rotator as defined in claim 30, further comprising:

a first set of radially inward ports for connecting a selected top connector with the rotator spool; and a second set of radially outward ports for connecting another selected top connector with the rotator spool.

32. A tubing rotator as defined in claim 30, further comprising:

the top connector including at least one of a flow-T housing and a BOP housing.

33. A tubing rotator as defined in claim 30, further comprising:

a retainer sub threadably secured to the rotator spool and including a plurality of circumferentially spaced ports each for receiving a securing member for rotatably connecting the retainer sub to the rotator spool; and a retainer plate removably secured to the retainer sub and including a plurality of circumferentially spaced ports for receiving a securing member to rotatably secure the retainer sub to the retainer plate.

34. A tubing rotator as defined in claim 30, wherein the double box bushing is unthreaded from the rotator spool and rethreaded to the rotator spool after the tension anchor is set.

* * * * *